United States Patent [19]

Smith

[11] Patent Number: 4,497,355

[45] Date of Patent: Feb. 5, 1985

[54] WOODWORK CUTTING DEVICE SUCH AS A WOOD CHISEL WITH SHARPENING GUIDES PROVIDED THEREWITH

[76] Inventor: Ulys Smith, 903 Neuse Dr., New Bern, N.C. 28560

[21] Appl. No.: 78,487

[22] Filed: Sep. 24, 1979

[51] Int. Cl.[3] ..... B25D 3/00

[52] U.S. Cl. ..... 145/24; 145/17

[58] Field of Search ..... 145/24, 17; 30/168; 125/41

[56] References Cited

U.S. PATENT DOCUMENTS

| | | | |
|---|---|---|---|
| 772 | 6/1807 | Glover et al. | 145/24 |
| 24,335 | 6/1859 | Seely et al. | 145/17 |
| 349,119 | 9/1886 | Phillips | 30/168 |
| 435,538 | 9/1890 | Fletcher | 145/24 |
| 746,286 | 12/1903 | Carleton | 145/17 |
| 2,191,679 | 2/1940 | O'Byrne | 145/17 |
| 4,063,356 | 12/1977 | Hepworth | 30/162 |

*Primary Examiner*—James G. Smith
*Assistant Examiner*—J. T. Zatarga
*Attorney, Agent, or Firm*—Mills & Coats

[57] ABSTRACT

The present invention relates to a woodwork cutting device such as wood chisel or plane iron blade having a cutting end, one side with a beveled cutting edge formed about the cutting end thereof, and opposite back side, and two side edges. Provided about the back side of the woodwork cutting device is a plurality of transversely extending and longitudinally spaced grinding guides that extend generally parallel with respect to the beveled cutting edge. This allows an individual sharpening the woodwork cutting device of the present invention to maintain the cutting edge perpendicular to the longitudinal axis of the blade. In addition, about at least one side edge of the blade portion of the woodwork cutting device is a series of grinding angle guides that extend in parallel relationship with the angle or plane of the beveled cutting edge. These grinding angle guides extend from the beveled cutting edge upwardly therefrom and enable one sharpening the woodwork cutting device of the present invention to sharpen the beveled cutting edge at an appropriate angle.

1 Claim, 4 Drawing Figures

WOODWORK CUTTING DEVICE SUCH AS A WOOD CHISEL WITH SHARPENING GUIDES PROVIDED THEREWITH

The present invention relates to wood cutting devices and implements and more particularly to wood chisels, plane iron blades and the like wherein the blade portion of these devices is provided with grinding guides for enabling the cutting edge to be properly sharpened.

BACKGROUND OF INVENTION

Sharpening woodwork cutting devices such as wood chisels and plane iron blades is not a simple task, especially for those that lack experience in doing such. Proper sharpening is very important if the implement or device is going to perform effectively, and moreover proper sharpening assures that maximum life will result and that the same will not prematurely have to be discarded.

With a woodwork cutting device such as a wood chisel or plane iron blade, effectiveness can be impaired by several different factors and circumstances. First, it is important that the cutting edge be sharpened such that the cutting edge is square with the blade portion of the woodwork cutting device. Expressed in another way, this means that the cutting edge should be straight and horizontal and generally extend perpendicular to the longitudinal axis of the blade forming a part of the woodwork cutting device.

Secondly, it is important that the cutting edge be shaped or beveled at a proper angle to assure effective and efficient performance. Usually this means that the cutting edge is beveled at approximately a 65 degree angle.

In the past, the angle of the beveled cutting edge and the alignment of the cutting edge has been left to the judgment and skill of the individual sharpening the device. Even under the best of circumstances, it is difficult for the most skilled individuals to properly sharpen such woodwork cutting devices by hand alone. It has been known to provide devices for holding and supporting the device to be sharpened while the same is moved into engagement with a grinding or sharpening stone. But the problem here is that such devices are expensive, inconvenient, and are not always practical to use.

Therefore, a need exists for some practical means to assist an individual in properly sharpening woodwork cutting devices such as a wood chisel or plane iron blade in order that the resulting cutting edge will be properly aligned and beveled.

SUMMARY OF INVENTION

In view of the above, the present invention entails a woodworking device in the form of a wood chisel or plane iron blade wherein the blade portion of such device is provided with grinding guides which an individual may use to assure that the cutting edge is sharpened squarely and that the angle of the beveled surface is properly angled.

In the case of a wood chisel, the same would include a blade portion having a cutting end and one side with the beveled cutting edge being from about the lower cutting end thereof, a back side opposite said one side, and two side edge portions. Transversely extending across the back side is a series of parallel spaced grinding guides that are formed from the cutting end upwardly, with the grinding guides being longitudinally spaced upward from the cutting edge. This allows the beveled cutting edge to be sharpened to where the end cutting edge extends straight across and is square with the side edges of the blade portion.

In addition, about at least one side edge of the blade portion there is provided a plurality of grinding angle guides. The grinding angle guides extend parallel with the appropriate angle of the beveled cutting edge surface such that as the cutting edge is sharpened periodically one can compare the resulting beveled edge with the inclination and direction of the lowermost grinding angle guide.

It is, therefore, an object of the present invention to provide a woodworking device such as a wood chisel or a blade for a plane iron wherein the blade portion of the device is provided with grinding guides for enabling an individual to properly sharpen the cutting edge of the blade forming a part of the device.

Still a further object of the present invention is to provide a woodworking device of the character described above where the blade includes front and back sides with a beveled cutting edge extending upwardly from a cutting end thereof along one side, and wherein about the other opposite side there is provided a series of transversely aligned laterally spaced grinding guides for assisting an individual in sharpening the cutting edge of the blade such that the cutting edge is maintained in parallel relationship with the grinding guides, especially the next most adjacent grinding guide.

A further object of the present invention is to provide a woodworking device of the character described above having grinding angle guides for assisting in grinding the beveled cutting edge of the device to a proper cutting angle.

More particularly a further object of the present invention resides in the provision of said grinding angle guides about at least one side edge of the blade portion forming a part of the woodwork device of concern with the grinding angle guides extending in spaced apart parallel relationship with the proper plane of the beveled cutting edge.

Other objects and advantages of the present invention will become apparent from a study of the following description and the accompanying drawings which are merely illustrative of the present invention.

DESCRIPTION OF PREFERRED EMBODIMENT

Figures 1, 2, 3, 4:
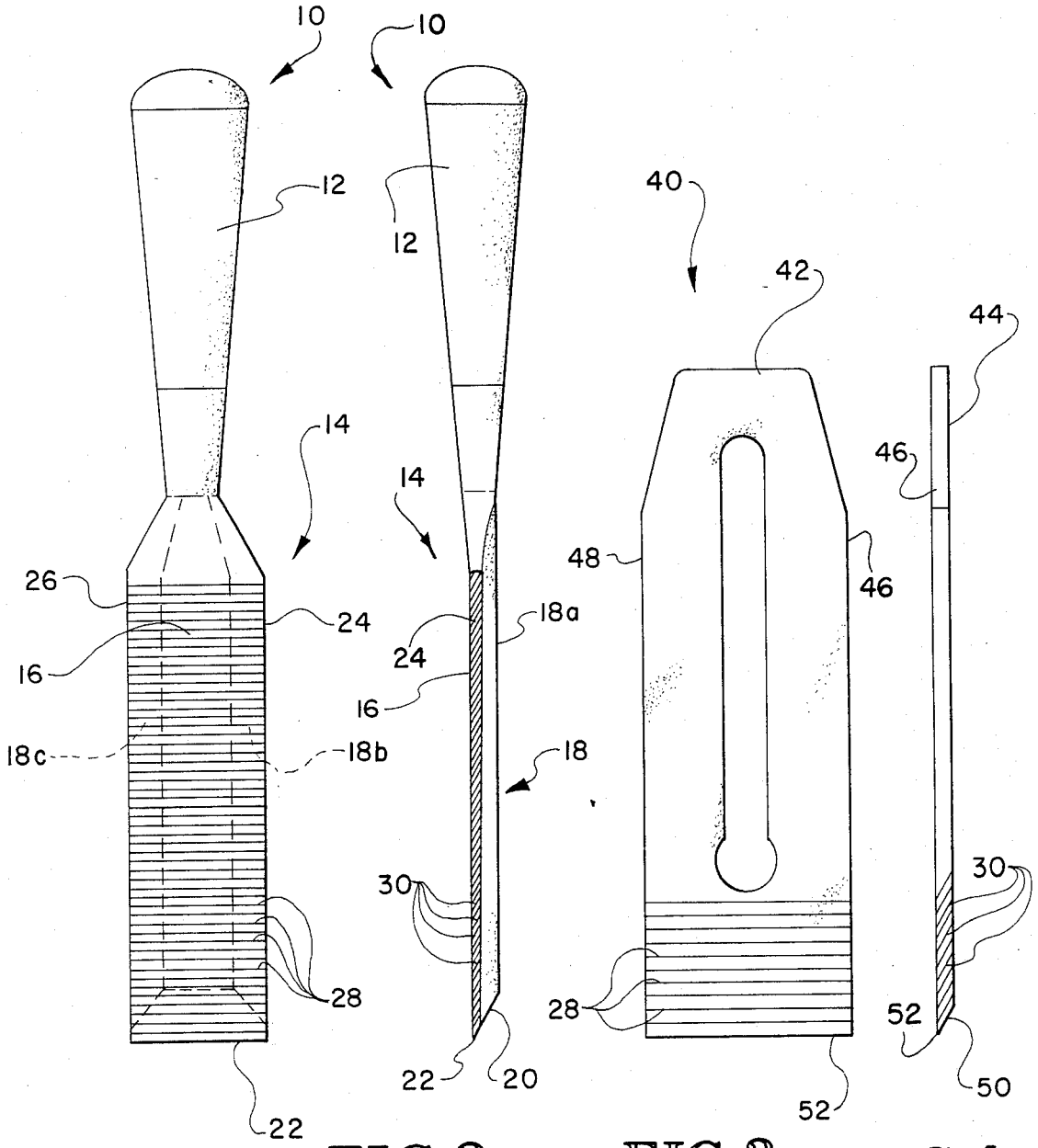
FIG. 1 is an elevational view of the back side of a wood chisel of the present invention illustrating grinding guides formed thereacross.
FIG. 2 is a side elevational view of the wood chisel of FIG. 1 illustrating grinding angle guides formed about a side edge portion thereof.
FIG. 3 is an elevational view of the back side of a blade for a plane iron illustrating the same type of grinding guides shown in FIG. 1.
FIG. 4 is a side elevational view of the blade of FIG. 3 illustrating grinding angle guides formed thereon.

With further reference to the drawings, two types of woodwork cutting devices of the character forming a part of the present invention are shown therein. In FIGS. 1 and 2, there is shown a wood chisel indicated by the numeral 10.

Wood chisel 10 comprises a handle portion 12 and a blade indicated generally by the numeral 14. Blade portion 14 includes a back side 16 and a front side indicated generally by the numeral 18, with the front side including an outwardly projecting center rib 18*a* and two flanking front side portions 18*b* and 18*c* that are disposed generally below the level of center rib 18*a*.

Formed about the lower portion of wood chisel 10 is a lower cutting end that includes a beveled cutting edge surface 20 and a cutting edge 22. Finally completing wood chisel 10, the same comprises a pair of side edges 24 and 26.

To assure the effectiveness of wood chisel 10 and to further prolong its life, it is important that the cutting edge 22 be sharpened appropriately and this includes sharpening the beveled cutting surface 20 at an appropriate angle. In particularly, as viewed in FIG. 1, cutting edge 22 should be straight and square with blade 14. As oriented and shown in FIG. 1, this means that cutting edge 22 should lie horizontal or perpendicular to the longitudinal axis of blade 14 and handle 12.

Generally the beveled cutting surface 20 should be maintained at approximately a 65 degree angle. As viewed in FIG. 2, this would mean a 65 degree angle with respect to a horizontal reference line extending across the cutting edge 22 and being disposed perpendicular to back 16.

To assist in sharpening wood chisel 10, first the present invention is provided with a series of grinding guides 28 disposed transversely across back 16 of wood chisel 10. It is seen that each of these grinding guides 28 is disposed in parallel relationship with the original cutting edge 22 and further that such grinding guides are longitudinally spaced about the back side 16 of wood chisel 10 in close spaced apart relationship such that as the cutting edge 22 is ground during the sharpening process that the same can be maintained in parallel relationship with the next adjacent grinding guide 28. The form of the grinding guide can vary. Grinding guides 28 may be actually inscribed into the back side 16 or may be placed thereon in any other suitable form. It is appreciated that grinding guides 28 may be provided about the substantial portion of back side 16 or even the entire back side, if so desired.

To assist in sharpening wood chisel 10 such that the bevel cutting surface 20 is maintained at a proper angle, there is provided along at least one side 24 or 26 a series of grinding angle guides 30. Grinding angle guides 30 extend in parallel relationship to the plane of the beveled cutting surface 20 and are closely spaced along one side in order that during the sharpening process, the beveled cutting surface 20 may be maintained and sharpened to an angle such that the beveled cutting surface 20 would extend parallel to the adjacent grinding angle guide 30. As pointed out hereinabove with respect to the grinding guides 28, any number of grinding angle guides can be provided and their spacing may vary. It should be pointed out that in certain situations it may be found that the beveled cutting surface 20 would be disposed at an angle other than 65 degrees.

Turning to FIGS. 3 and 4, another form of the woodwork cutting device of the present invention is shown, and in this case the form is that of a plane iron blade indicated generally by the numeral 40. Viewing blade 40 briefly, it is seen that the same includes a back 42, a front side 44, sides 46 and 48, a beveled cutting surface 50 and a cutting edge 52. As in the case of wood chisel 10, the plane iron blade 40 is provided in exactly the same manner with a series of grinding guides 28 that will assist an individual in sharpening the cutting edge 52 such that it is maintained in a proper or square relationship with the blade 40 as a whole. In addition, the grinding angle guides 30 shown in FIG. 4 are disposed and formed in the same like manner as that described in FIG. 2 for the wood chisel, and their utility is the same. Consequently, insofar as a discussion of the plane iron blade 40 shown in FIGS. 3 and 4 goes, it is not deemed necessary to go into a detail discussion of such because the same has already been described with respect to the wood chisel 10 shown in FIGS. 1 and 2.

From the foregoing discussion, it is appreciated that the present invention discloses an improved woodwork cutting device in the form of either a wood chisel 10 or plane iron blade 40 wherein the same is provided with grinding guides for enabling the cutting edge 22 or 52 of the respective devices to be maintained in proper relationship with respect to the associated blade portion as a whole. Further it is appreciated that the grinding angle guides 30 enable the beveled cutting surface of both devices to be maintained at an appropriate angle. It is also noted that these grinding guides are associated directly on and with the device to be sharpened, and is not provided as an expensive, complicated auxiliary attachment. Thus the present invention presents a new and improved woodwork cutting device in the form of a wood chisel 10 or plane iron blade 40 that is practical, simple, and relatively inexpensive.

The terms "upper", "lower", "forward", "rearward", etc., have been used herein merely for the convenience of the foregoing specification and in the appended claims to describe the wood chisel or plane iron blade and its parts as oriented in the drawings. It is to be understood, however, that these terms are in no way limiting to the invention since the wood chisel or plane iron blade may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A woodwork cutting device such as a wood chisel or plane iron blade having a blade portion including two side edges, a cutting end and opposite front and back faces, the front face having a beveled cutting edge formed thereon adjacent said cutting end, a plurality of spaced grinding guide means formed transversely across said back face of said woodwork cutting device and extending in general parallel relationship with said cutting end for enabling said cutting end to be properly sharpened, while the front face and beveled edge is turned downwardly away from the individual sharpening the device, by grinding the cutting end such that it is maintained parallel with the adjacent transverse guide means formed across the back face of said woodwork cutting device, said beveled cutting edge being formed at a selection angle relative to side edges of said blade portion, and wherein there is provided a plurality of grinding angle guides formed on at least one side edge of said blade portion with said grinding angle guides extending in side by side parallel relationship with respect to each other and oriented generally parallel to and at approximately the same angle as the place of said beveled cutting edge such that during the sharpening process the grinding angle guides can be utilized to sharpen the beveled cutting edge at a proper angle relative to the side edges of the blade portion.

* * * * *